US009517872B2

(12) United States Patent
Murano et al.

(10) Patent No.: US 9,517,872 B2
(45) Date of Patent: Dec. 13, 2016

(54) PACKING BODY

(75) Inventors: Tomofumi Murano, Aichi (JP); Kazuyoshi Minaminaka, Mie (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1184 days.

(21) Appl. No.: 13/267,018

(22) Filed: Oct. 6, 2011

(65) Prior Publication Data

US 2012/0097569 A1 Apr. 26, 2012

(30) Foreign Application Priority Data

Oct. 25, 2010 (JP) ..... 2010-238466

(51) Int. Cl.
*B65D 81/02* (2006.01)
*B65D 81/113* (2006.01)
*B65D 77/04* (2006.01)

(52) U.S. Cl.
CPC ..... *B65D 81/113* (2013.01); *B65D 77/04* (2013.01); *B65D 2585/6892* (2013.01)

(58) Field of Classification Search
CPC ..... B65D 81/113; B65D 81/107; B65D 2581/053; B65D 81/056; B65D 5/5035; B65D 5/5045; B65D 77/04; B65D 2585/6892
USPC ..... 206/523, 587, 591, 592, 594, 521, 320,206/590, 585, 586, 576, 453, 701, 722, 723,206/593, 720, 770
See application file for complete search history.

(56) References Cited

U.S. PATENT DOCUMENTS 5,249,685 A * 10/1993 Stephens ..... 206/523
5,450,948 A * 9/1995 Beausoleil et al. ..... 206/204
6,405,873 B2 * 6/2002 Koike ..... 206/592
6,986,456 B2 * 1/2006 Jone ..... B65D 5/328 229/117.11
7,328,800 B2 * 2/2008 Koike ..... 206/521
7,424,954 B2 * 9/2008 Otsuka et al. ..... 206/576
(Continued)

FOREIGN PATENT DOCUMENTS

CN 2806342 Y 8/2006
CN 2897869 Y 5/2007
(Continued)

OTHER PUBLICATIONS

Jul. 29, 2014—(CN) The Second Office Action—App 201110322051.2—Eng Tran.
(Continued)

*Primary Examiner* — Jacob K Ackun
*Assistant Examiner* — Jenine Pagan
(74) *Attorney, Agent, or Firm* — Banner & Witcoff, Ltd.

(57) ABSTRACT

A packing body is provided, which is configured to pack an intended apparatus therein. The packing body includes a first sheet formed in such a bag shape as to entirely wrap the intended apparatus therein, a cushion member configured to protect at least a corner of an outer surface of the intended apparatus wrapped in the first sheet, a second sheet configured to be placed between the first sheet and the cushion member at the corner of the outer surface of the intended apparatus packed in the packing body, the second sheet being further configured to cause a lower frictional force between the second sheet and the first sheet than between the second sheet and the cushion member, and a packing box configured to entirely cover the intended apparatus from an outside of the cushion member.

8 Claims, 7 Drawing Sheets

(56) References Cited

U.S. PATENT DOCUMENTS

| | | | | |
|---|---|---|---|---|
| 2002/0189970 | A1* | 12/2002 | Koike | 206/592 |
| 2006/0219596 | A1* | 10/2006 | Lin et al. | 206/592 |
| 2007/0199855 | A1* | 8/2007 | Lim | B65D 65/406 206/523 |
| 2008/0067096 | A1 | 3/2008 | Maruta | |
| 2009/0107879 | A1* | 4/2009 | Otsuka | B65D 5/5028 206/589 |

FOREIGN PATENT DOCUMENTS

| | | | |
|---|---|---|---|
| JP | 04-253663 | | 9/1992 |
| JP | H09-95361 | A | 4/1997 |
| JP | H10-147372 | A | 6/1998 |
| JP | 2000-203678 | A | 7/2000 |
| JP | 2006-044671 | | 2/2006 |
| JP | 2007-069922 | A | 3/2007 |
| JP | 2007-137505 | | 6/2007 |
| JP | 2008-189371 | A | 8/2008 |
| JP | 4310677 | B2 | 8/2009 |
| JP | 4496730 | B2 | 7/2010 |
| JP | 2010-173667 | A | 8/2010 |

OTHER PUBLICATIONS

The First Office Action mailed Jan. 20, 2014, CN appln. 201110322051.2, English translation.
Notification of Reasons for Rejection mailed Jan. 7, 2014, JP appln. 2010-238466, English translation.

* cited by examiner

PACKING BODY

CROSS-REFERENCE TO RELATED APPLICATION

This application claims priority under 35 U.S.C. §119 from Japanese Patent Application No. 2010-238466 filed on Oct. 25, 2010. The entire subject matter of the application is incorporated herein by reference.

BACKGROUND

Technical Field

The following description relates to one or more techniques to pack an intended apparatus in a packing body including a cushion member and a packing box.

Related Art

So far, a packing body (a packing tool) has been known, which is configured to pack therein an intended apparatus (e.g., an image forming apparatus) set in a predetermined position on a pallet with cushion members (shock absorbing members) being pressed against the apparatus from above by a top plate or a face plate. Thus, owing to the cushion members of the packing body, it is possible to protect the apparatus from being damaged by a shock at the time of transportation of the packing body packing therein the apparatus.

SUMMARY

The apparatus, to be packed in the packing body, may include one or more elements that might be deteriorated due to an influence of humidity in the atmosphere. As an example of the elements, toner for an image forming apparatus is cited. Further, the elements, which might negatively be affected by the humidity, may be packed together with the apparatus in the packing body. When such elements are packed together with the apparatus in the known packing body, the elements might be deteriorated due to the influence of the humidity, since the known packing body is not configured with any measures against the humidity.

As a measure to prevent the elements from being deteriorated due to the influence of the humidity, it is considered to place the apparatus and the elements along with a desiccant in a well-sealed circumstance. Specifically, the apparatus and the elements may be wrapped together with the desiccant by a bag-shaped airtight sheet. In this case, since the desiccant absorbs vapor in the atmosphere, it is possible to make lower the humidity around the apparatus and the elements wrapped by the bag-shaped airtight sheet, and to maintain each element under a preferred condition therefor.

When the aforementioned known packing body is applied to the apparatus wrapped together with the desiccant by the bag-shaped airtight sheet, the bag-shaped airtight sheet is placed between the surface of the apparatus and the cushion members. In this case, when a shock is applied to the packing body at the time of transportation thereof, the bag-shaped airtight sheet might be damaged to have a break due to a great frictional force at a contact interface between the cushion members and the bag-shaped airtight sheet. Owing to the break of the bag-shaped airtight sheet, the sheet loses its airtightness, such that an outside air freely flows into the sheet. Consequently, a great amount of outside air flows into the bag-shaped sheet beyond the vapor absorbing capability of the desiccant, and the humidity inside the sheet rises so much as to deteriorate the elements.

Aspects of the present invention are advantageous to provide one or more improved techniques for packing an intended apparatus (wrapped together with a desiccant) in a sheet with a cushion member, which techniques make it possible to prevent the sheet from being broken or damaged and to maintain a preferred degree of humidity inside the sheet.

According to aspects of the present invention, a packing body is provided, which is configured to pack an intended apparatus therein. The packing body includes a first sheet formed in such a bag shape as to entirely wrap the intended apparatus therein, a cushion member configured to protect at least a corner of an outer surface of the intended apparatus wrapped in the first sheet, a second sheet configured to be placed between the first sheet and the cushion member at the corner of the outer surface of the intended apparatus packed in the packing body, the second sheet being further configured to cause a lower frictional force between the second sheet and the first sheet than between the second sheet and the cushion member, and a packing box configured to entirely cover the intended apparatus from an outside of the cushion member.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect.

<First Embodiment>

Hereinafter, a first embodiment according to aspects of the present invention will be described with reference to FIGS. 1 to 6. It is noted that, in the following description, a front-to-rear direction, a left-to-right direction, and an up-to-down direction (the vertical direction) will be defined with respect to a multi-function peripheral (MFP) 10 as shown in FIG. 1.

Figure 1:
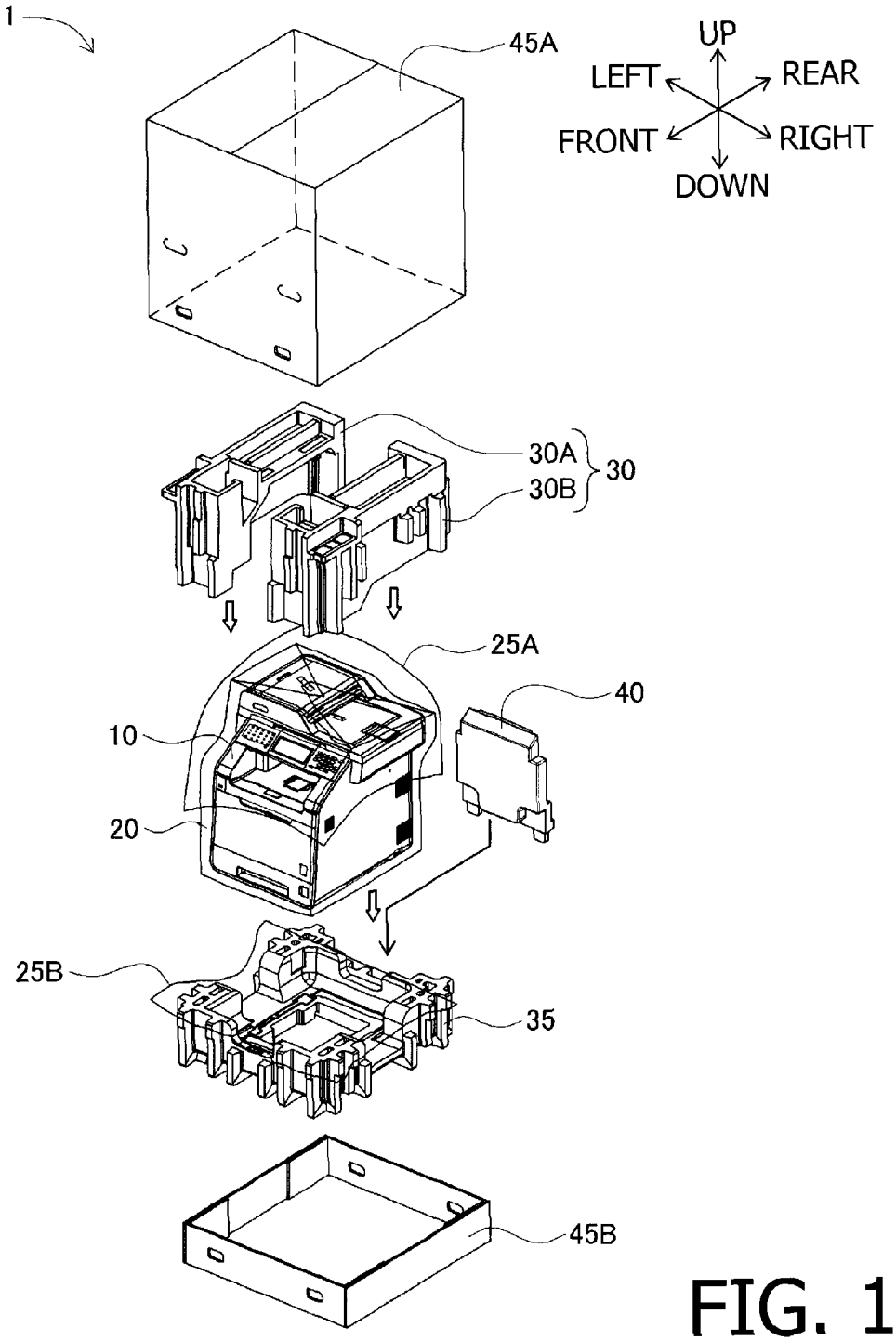
FIG. 1 is a perspective view showing an overall configuration of a packing body for packing an MFP in a first embodiment according to one or more aspects of the present invention.

As illustrated in FIG. 1, a packing body 1 of the first embodiment includes the MFP 10 to be packed, a wrapping bag 20, a protection sheet 25, an upper cushion member 30, a lower cushion member 35, a rear cushion member 40, and a cardboard box 45.

The MFP 10 has a printing function to form an image with toner on a recording medium, a scanning function, a copy function, and a facsimile function. The MFP 10 is an intended apparatus to be packed in the packing body 1 of the first embodiment. The MFP 10 includes a drawer 15, housed in a main body housing 11, which is attached with a plurality of process cartridges 16 (see FIG. 3). Each process cartridge 16 is configured to accommodate toner to be used for forming an image on a sheet. Further, the main body housing 11 has corners such as a first corner 11A, a second corner 11B, and a third corner 11C. The corners will be described in detail later with reference to the relevant drawings.

The wrapping bag 20 is an HDPE (High Density Polyethylene) sheet formed in a bag shape. The wrapping bag 20 is used to wrap therein the MFP 10 together with a desiccant D.

The protection sheet 25 is a HDPE sheet, which is placed between the wrapping bag 20 and the cushion members 30 and 35 when the MFP 10 is packed.

In the first embodiment, the protection sheet 25 includes an upper protection sheet 25A and a lower protection sheet 25B. The upper protection sheet 25A is placed between the upper cushion member 30 and the wrapping bag 20 when the MFP 10 is packed. The lower protection sheet 25B is placed between the lower cushion member 35 and the wrapping bag 20 when the MFP 10 is packed.

The upper cushion member 30 is formed from foamed polystyrene, which is polystyrene hardened after being foamed with fine bubbles. The upper cushion member 30 fills spaces between the cardboard box 45 and corners (e.g., the below-mentioned first corner 11A) of an upper portion of the MFP 10, so as to protect the MFP 10 from a shock at the time of transporting the packing body 1.

The upper cushion member 30 includes a first upper cushion member 30A and a second upper cushion member 30B. The first upper cushion member 30A is placed across an upper left portion to a left side face of the MFP 10 to fill spaces between the cardboard box 45 and corners at an upper left side and a front left side of the MFP 10. Thereby, the first upper cushion member 30A protects the MFP 10 from the impact at the time of transporting the packing body 1. The first upper cushion member 30A has an apparatus contact surface formed at a portion thereof facing the MFP 10 based on the shape of the MFP 10.

The second upper cushion member 30B is placed across an upper right portion to a right side face of the MFP 10 to fill spaces between the cardboard box 45 and corners at an upper right side and a front right side of the MFP 10. Thereby, the second upper cushion member 30B protects the MFP 10 from the impact at the time of transporting the packing body 1. The second upper cushion member 30B has an apparatus contact surface formed at a portion thereof facing the MFP 10 based on the shape of the MFP 10.

The lower cushion member 35 is formed from foamed polystyrene, which is polystyrene hardened after being foamed with fine bubbles. The lower cushion member 35 fills spaces between the cardboard box 45 and corners (e.g., the below-mentioned third corner 11C) of a lower portion of the MFP 10, so as to protect the MFP 10 from the impact at the time of transporting the packing body 1. Further, the lower cushion member 35 includes a loading section formed on an upper surface thereof based on a shape around a bottom surface of the MFP 10. Therefore, when placed on the loading section, the MFP 10 is packed in a state positioned in a predetermined location on the lower cushion member 35.

The rear cushion member 40 is formed from foamed polystyrene, which is polystyrene hardened after being foamed with fine bubbles. When attached to the lower cushion member 35, the rear cushion member 40 protects the MFP 10 from the impact at the time of transporting the packing body 1. Further, in an assembled configuration of the packing body 1, an upper end of the rear cushion member 40 is located closer to the MFP 10 than a lower end of the upper cushion member 30. Accordingly, since the rear cushion member 40 is fixedly positioned by the upper cushion member 30, it is possible to prevent a door (not shown), which is provided in an openable and closable manner at a rear face of the MFP 10, from being opened by the impact at the time of transporting the packing body 1.

The cardboard box 45 forms outer surfaces of the packing body 1, and covers the MFP 10, the wrapping bag 20, and the protection sheet 25 from the outside of the upper cushion member 30, the lower cushion member 35, and the rear cushion member 40. The cardboard box 45 includes an upper cardboard box 45A and a lower cardboard box 45B. The upper cardboard box 45A forms an upper portion of the cardboard box 45, and covers a major part of the MFP 10. Further, the upper cardboard box 45A is configured such that an inner surface thereof contacts the upper cushion member 30 and the rear cushion member 40 and presses the upper cushion member 30 toward the MFP 10. The lower cardboard box 45B, which forms a bottom portion of the cardboard box 45, accommodates the lower cushion member 35.

Subsequently, a detailed explanation will be provided about a procedure of a packing process to pack the MFP 10 in the packing body 1 of the first embodiment, with reference to the relevant drawings.

Figure 2:
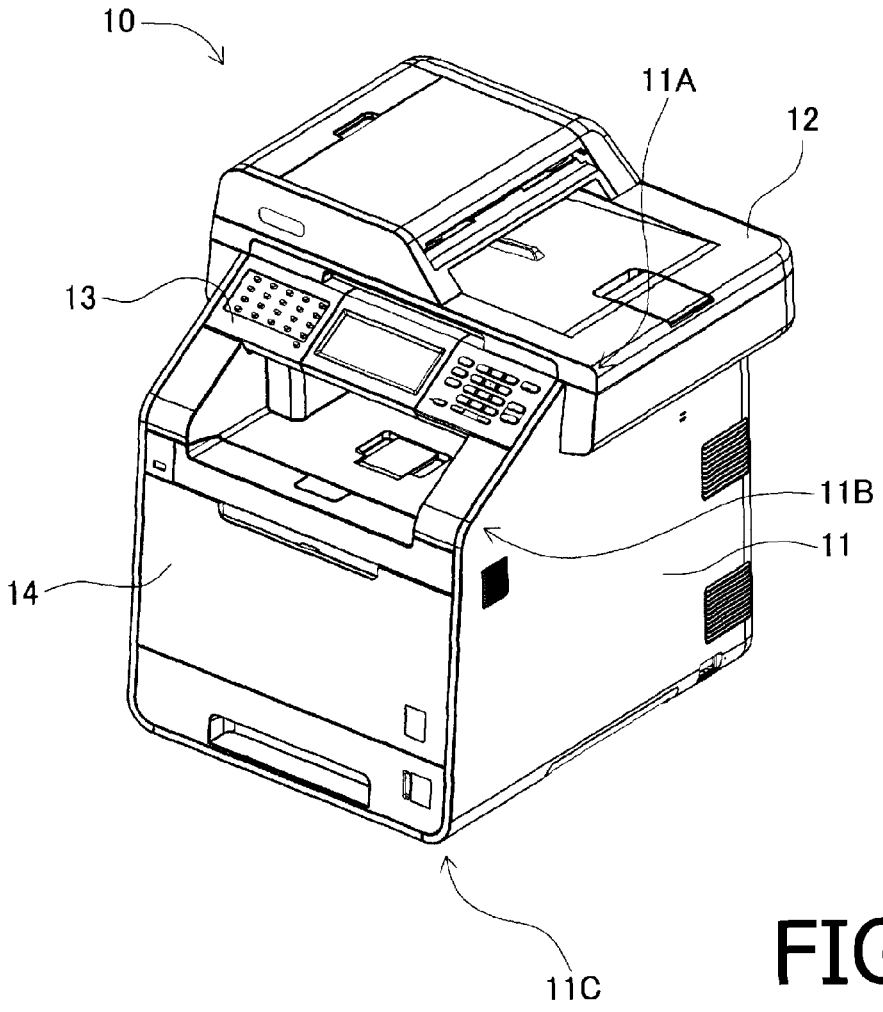
FIG. 2 is an external perspective view of the MFP to be packed in the packing body in the first embodiment according to one or more aspects of the present invention.

Firstly, an explanation will be provided about a configuration of the MFP 10 to be packed in the packing body 1 and operations to be performed for the MFP 10 in the packing process, with reference to FIG. 2. The MFP 10 includes a scanning unit (not shown) at an upper surface portion of the main body housing 11. Further, the MFP 10 includes various components such as a printer unit inside the main body housing 11.

In addition, the MFP 10 includes an upper cover 12, an operation panel 13, and a front cover 14. The upper cover 12 is provided at an upper portion of the main body housing 11 to be openable and closable in the vertical direction. When closed, the upper cover 12 holds a document sheet to be scanned, on a contact glass of the scanning unit. The operation panel 13 includes a plurality of input keys and a display device. The operation panel 13 is disposed on a slanted surface, which is slanted to be lower toward the front side, at a front face side of the main body housing 11. The front cover 14 is provided at a lower portion of the front face of the main body housing 11 to be openable and closable. When the front cover 14 is opened, the drawer 15 is attached in the main body housing 11.

Here, an explanation will be provided about corners of the MFP 10, with the first corner 11A, the second corner 11B, and the third corner 11C as examples. It is noted that each corner of the main body housing 11 mentioned here denotes a portion that is configured with three surfaces at least two of which intersect each other at a right angle (or a sharp angle).

The first corner 11A is a corner located at an upper right portion on a front side of the upper cover 12. As depicted in FIG. 2, the first corner 11A is formed substantially with an upper face, a front face, and a right side face of the upper cover 12. At least, each of the upper face and the right side face of the upper cover 12 intersects the front face of the upper cover 12 substantially at a right angle.

The second corner 11B is formed substantially with the slanted surface on which the operation panel 13 is provided, the front face of the main body housing 11, and a right side face of the main body housing 11. As shown in FIG. 2, the second corner 11B is configured with each of the slanted surface and the front face of the main body housing 11 intersecting the right side face of the main body housing 11 substantially at a right angle.

The third corner 11C is a corner located at a lower right portion on a front side of the main body housing 11. As shown in FIG. 2, the third corner 11C is formed substantially with the front face, the right side face, and a bottom surface of the main body housing 11. The third corner 11C is configured with each of the bottom surface and the right side face of the main body housing 11 intersecting the front face of the main body housing 11 substantially at a right angle. Further, although detailed explanation about them will be omitted, there are a plurality of corners at a left side of the MFP 10. In the same manner as the first to third corners 11A, 11B, and 11C, each of the corners at the left side of the MFP 10 is configured with three surfaces at least two of which intersect each other at a right angle (or a sharp angle).

Figure 3:
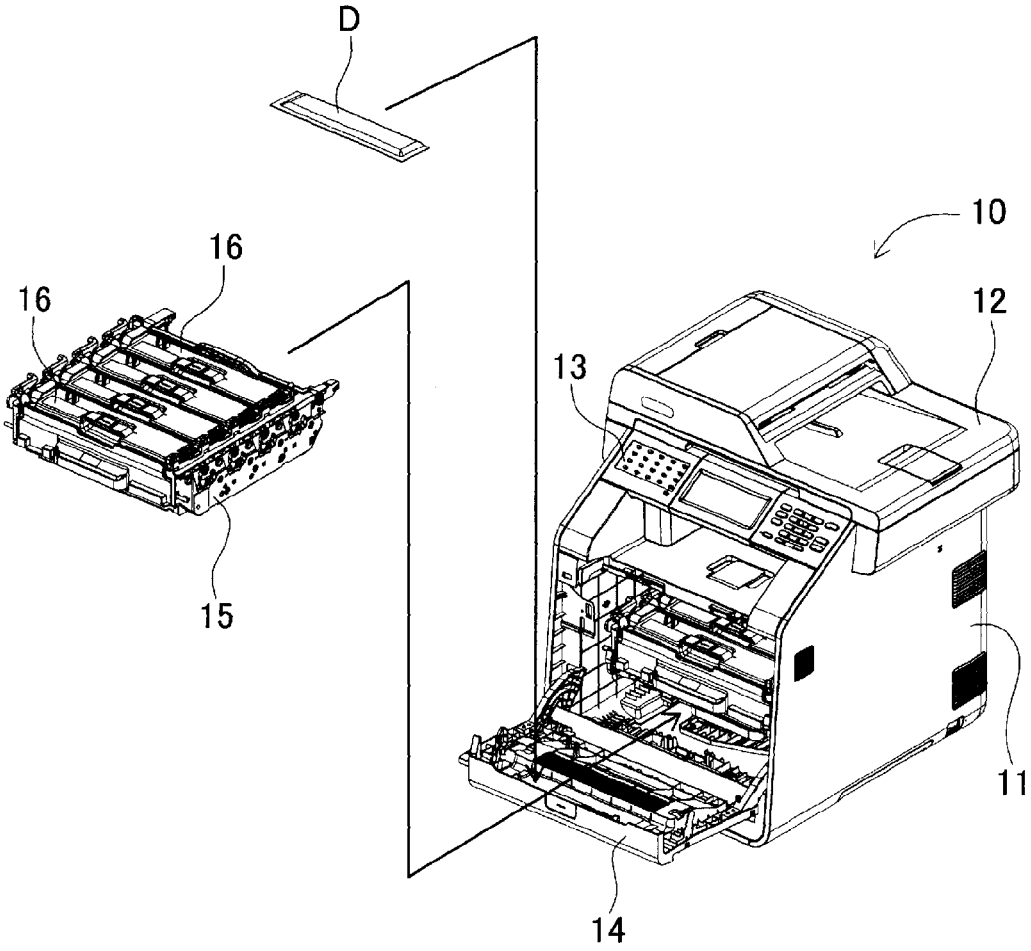
FIG. 3 is a perspective view showing the MFP, a desiccant, and a drawer attached with a plurality of process cartridges to be packed together in the packing body in the first embodiment according to one or more aspects of the present invention.

Subsequently, a detailed explanation will be provided about operations for packing the MFP 10 in the packing body 1 of the first embodiment, with reference to FIGS. 3 to 5. As illustrated in FIG. 3, initially, a packing operator opens the front cover 14, and then attaches the drawer 15, which is attached with the process cartridges 16, to a predetermined position inside the main body housing 11. Each process cartridge 16 stores therein toner to be used for image formation by the MFP 10. The toner might be affected by humidity to be deteriorated. Further, the packing operator attaches the desiccant D, which is configured for instance with silica gel, to an attaching portion formed on an inner wall surface of the front cover 14, and then closes the front cover 14. Thus, by attaching the process cartridges 16 (toner) into the MFP 10 prior to packing the MFP 10, it is possible to make smaller the object to be packed.

After attaching the drawer 15 and the desiccant D into the main body housing 11 of the MFP 10, the packing operator wraps the MFP 10 in the wrapping bag 20. At that time, the packing operator seals the wrapping bag 20, which wraps therein the MFP 10, with adhesive tape so as to enhance the airtightness of the inside of the wrapping bag 20 (see FIG. 4). Thereby, the inside of the wrapping bag 20 becomes a low-humidity environment owing to the desiccant D.

After wrapping the MFP 10 in the wrapping bag 20, the packing operator attaches the rear cushion member 40 to a predetermined position on a rear face side of the lower cushion member 35, and spreads the lower protection sheet 25B on the loading section of the lower cushion member 35. Then, the packing operator places the MFP 10 wrapped in the wrapping bag 20, on the loading section of the lower cushion member 35 with the lower protection sheet 25B spread thereon (see FIG. 4). Thereby, the lower portion of the MFP 10 is put into a state where the lower protection sheet 25B is disposed between the lower cushion member 35 and the wrapping bag 20. It is noted that the lower protection sheet 25B is formed with such a size as to reach the third corner 11C on the right side of the MFP 10 and a similar corner on the left side of the MFP 10 when the MFP 10 is placed on the lower protection sheet 25B.

Figure 4:
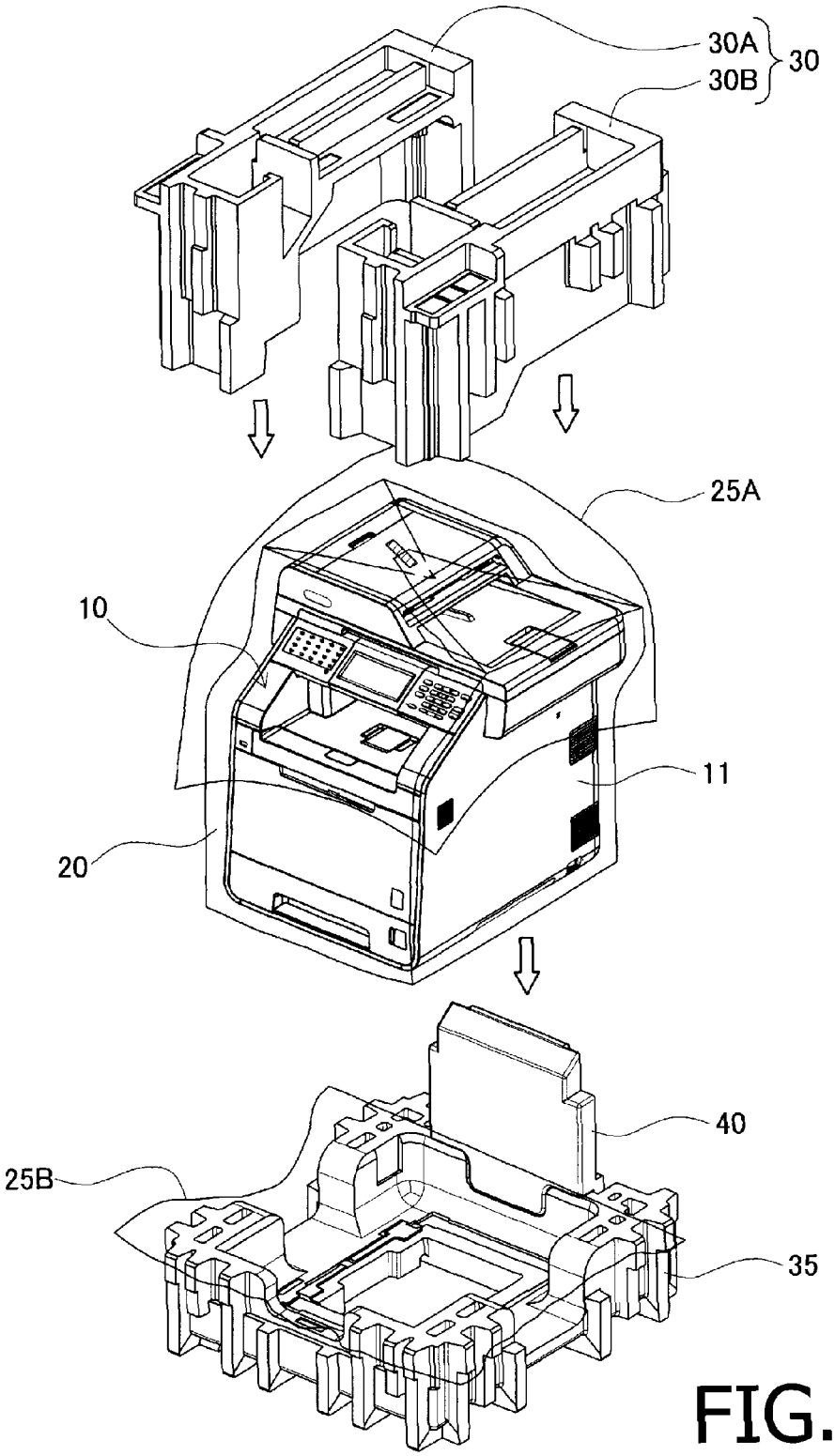
FIGS. 4 and 5 illustrate a procedure of packing the MFP in the first embodiment according to aspects of the present invention.
Figure 5:
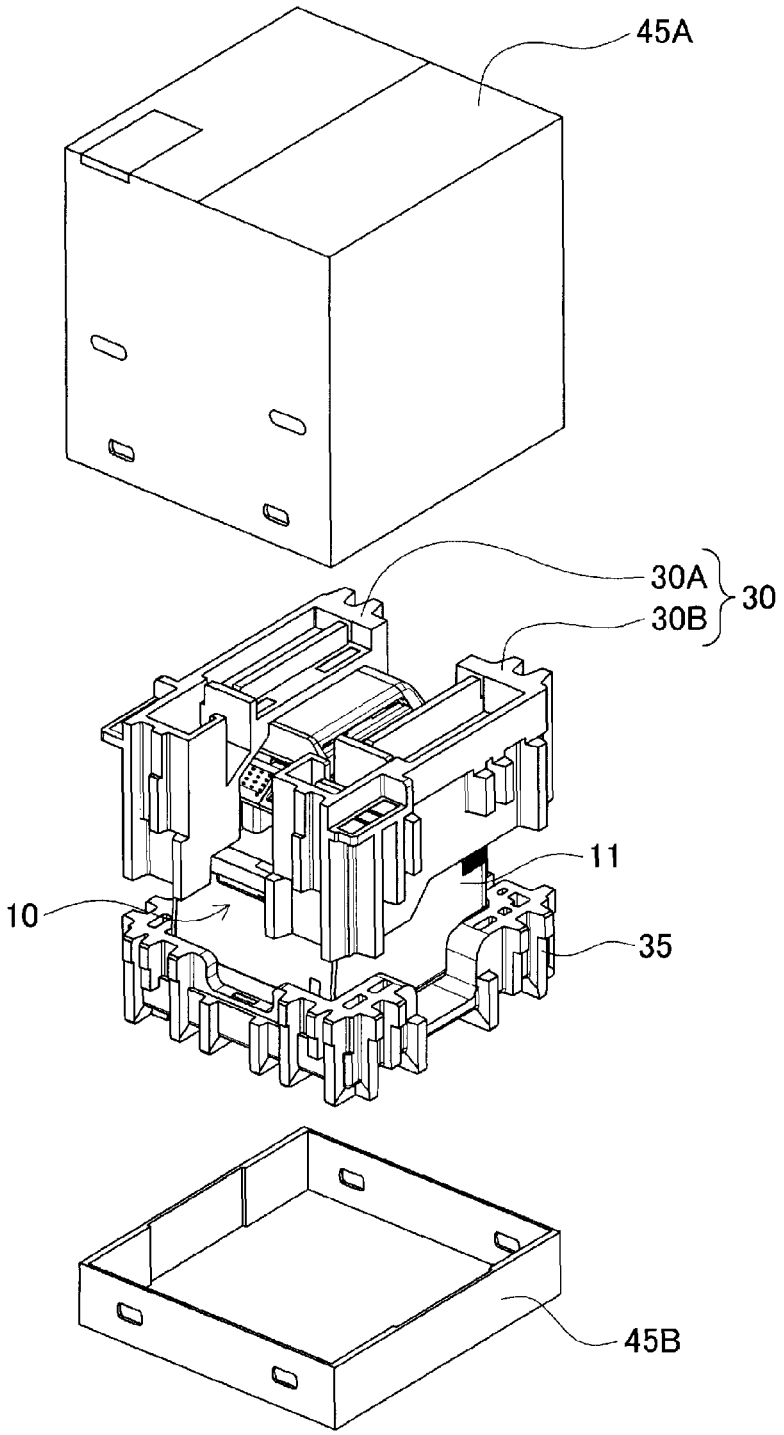

Further, the packing operator covers an upper portion of the MFP 10 wrapped in the wrapping bag 20, with the upper protection sheet 25A (see FIG. 4). After that, the packing operator attaches the upper cushion member 30 (the first upper cushion member 30A and the second upper cushion member 30B) to the upper portion of the MFP 10 wrapped in the wrapping bag 20, over the upper protection sheet 25A. Thereby, the upper portion of the MFP 10 is put into a state where the upper protection sheet 25A is disposed between the upper cushion member 30 and the wrapping bag 20 (see FIG. 6). It is noted that the upper protection sheet 25A is formed with such a size as to reach the first corner 11A on the right side of the MFP 10 and a similar corner on the left side of the MFP 10 when the MFP 10 is covered from above with the upper protection sheet 25A.

Further, at this time, the packing operator attaches one of the first upper cushion member 30A and the second upper cushion member 30B to a corresponding side (end) of the upper portion of the MFP 10 wrapped in the wrapping bag 20. Thereafter, the packing operator attaches the other one of the first upper cushion member 30A and the second upper cushion member 30B to the other side (end) of the upper portion of the MFP 10 wrapped in the wrapping bag 20. Thus, the operation of attaching the upper cushion member 30 is performed with the separate operations, i.e., the operation of attaching the first upper cushion member 30A and the operation of attaching the second upper cushion member 30B. Thereby, the packing operator can accurately put the upper protection sheet 25A in any of between the first upper cushion member 30A and the wrapping bag 20 and between the second upper cushion member 30B and the wrapping bag 20. Namely, since the upper cushion member 30 is divided into the first upper cushion member 30A and the second upper cushion member 30B each of which is formed with a smaller size, the packing operator can easily handle the upper cushion member 30. Thereby, the packing operator can attach the first upper cushion member 30A and the second upper cushion member 30B to the upper portion of the MFP 10, while holding the upper protection sheet 25A in an appropriate position. Thus, it is possible to attach the upper cushion member 30 while preventing the upper protection sheet 25A from being positioned inappropriately.

After attaching the upper cushion member 30, the lower cushion member 35, and the rear cushion member 40 to the MFP wrapped in the wrapping bag 20, the packing operator firstly puts the lower cushion member 35 (and the lower portion of the MFP 10 attached with the lower cushion member 35) into the lower cardboard box 45B. Then, the packing operator puts the upper cardboard box 45A over the upper portion of the MFP 10 attached with the upper cushion member 30. Thereby, the packing operator finishes the packing process to pack the MFP 10 in the packing body 1 of the first embodiment. Thus, according to the packing body 1 of the first embodiment, it is possible to put the protection sheet 25 between the wrapping bag 20 and the cushion members (the upper cushion member 30 and the rear cushion member 40) in the vicinity of the corners of the MFP 10, by the aforementioned simple operations.

Next, a detailed explanation will be provided about configurations of the packing body 1 around the corners of the MFP 10 in the first embodiment, with reference to the relevant drawings. In the following description, an explanation will be provided about a configuration of the packing body 1 around the first corner 11A, which will be cited as an example of the corners of the MFP 10. In this regard, regarding the other corners such as the second corner 11B and the third corner 11C as well, the packing body 1 has the same configurations around the other corners (as the configuration of the packing body 1 around the first corner 11A) so as to provide the same effects.

Figure 6:
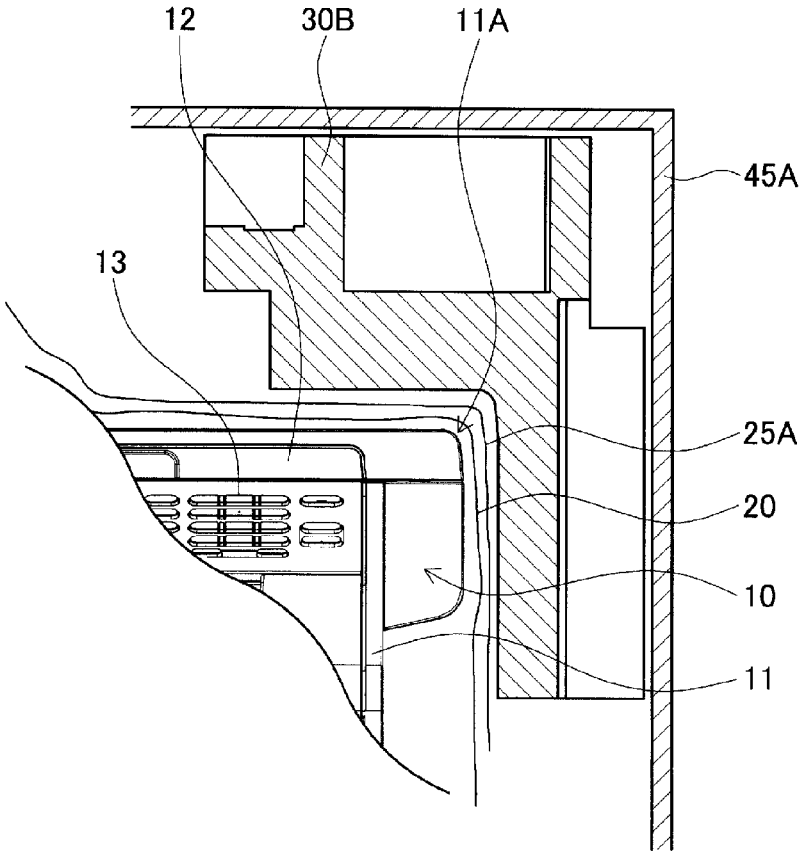
FIG. 6 shows a configuration around a first corner of the MFP packed in the packing body in the first embodiment according to one or more aspects of the present invention.

As shown in FIG. 6, according to the packing body 1 of the first embodiment, in the vicinity of the first corner 11A as well, the upper protection sheet 25A is placed between the wrapping bag 20 and the second upper cushion member 30B. The second upper cushion member 30B is formed from so-called "foamed polystyrene." Each of the wrapping bag 20 and the upper protection sheet 25A is configured with the HDPE sheet. Further, the second upper cushion member 30B has the apparatus contact surface formed along the shape of the first corner 11A of the MFP 10. In the state where the MFP 10 is completely packed, the second upper cushion member 30B is pressed against the first corner 11A via the wrapping bag 20 and the upper protection sheet 25A. Accordingly, when a shock is applied to the packing body 1 at the time of transportation of the packing body 1, the upper protection sheet 25A might be broken owing to a frictional force caused between the upper protection sheet 25A and the second upper cushion member 30B. However, since a frictional force caused between the upper protection sheet 25A and the wrapping bag 20 is so low that the upper protection sheet 25A can slip relative to the wrapping bag 20, it is possible to prevent the wrapping bag 20 from being broken together with the upper protection sheet 25A. In other words, the upper protection sheet 25A is configured to cause a lower frictional force between the upper protection sheet 25A and the wrapping bag 20 than between the upper protection sheet 25A and the second upper cushion member 30B.

Namely, according to the packing body 1 of the first embodiment, when a shock is applied to the packing body 1 at the time of transportation of the packing body 1, it is possible to prevent the wrapping bag 20 from being broken or damaged, even around the corners of the MFP 10 where the wrapping bag 20 and the protection sheet 25 are the most likely to be damaged. In other words, according to the packing body 1 of the first embodiment, even though a shock is applied to the packing body 1 at the time of transportation of the packing body 1, it is possible to maintain a low degree of humidity inside the wrapping bag 20. Thereby, the packing body 1 makes it possible to prevent the toner, which is wrapped in the wrapping bag 20 together with the MFP 10 and the desiccant D, from being deteriorated.

(Second Embodiment)

Subsequently, a second embodiment will be described with reference to FIG. 7. In the second embodiment, basic configurations of the MFP 10, the wrapping bag 20, the upper cushion member 30, the lower cushion member 35, the rear cushion member 40, and the cardboard box 45 are the same as those in the first embodiment. Therefore, explanations about those configurations will be omitted.

Figure 7:
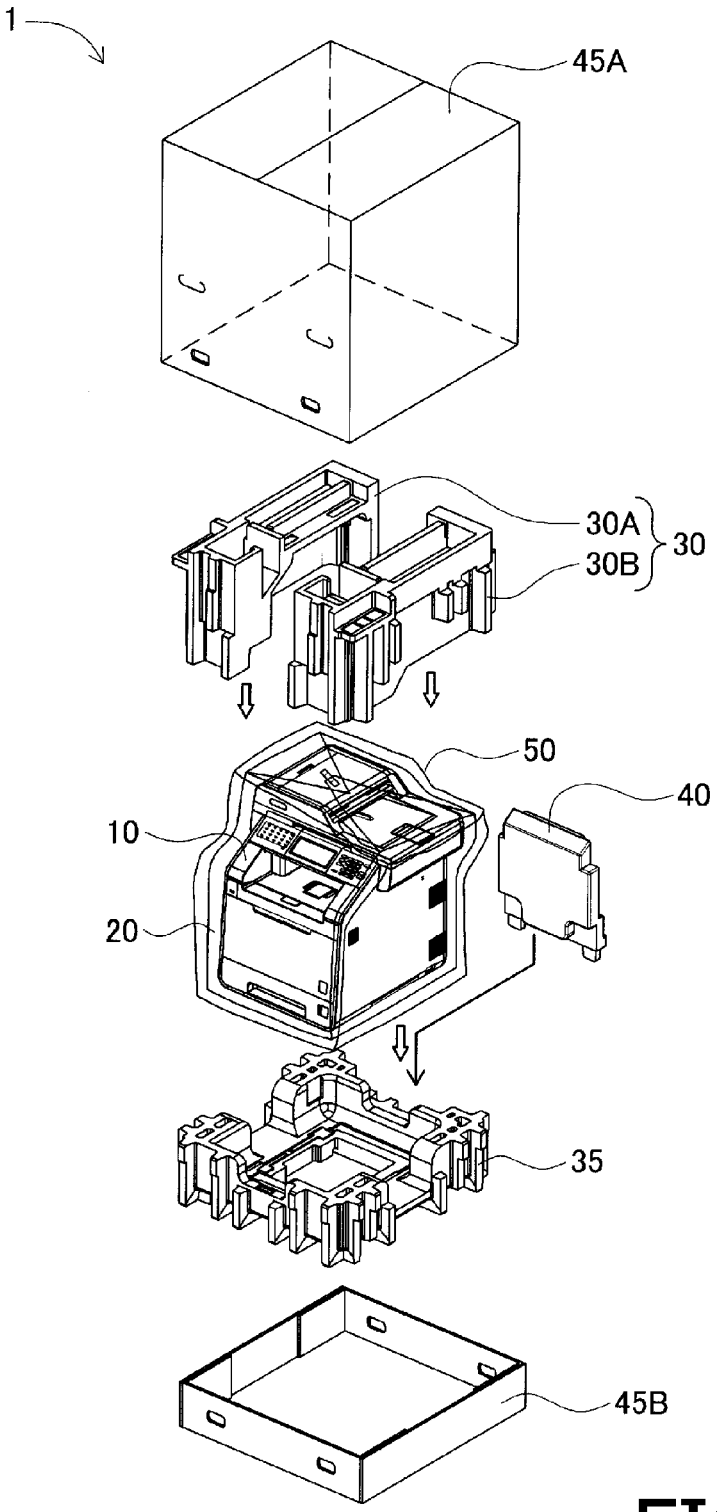
FIG. 7 is a perspective view showing an overall configuration of a packing body for packing the MFP in a second embodiment according to one or more aspects of the present invention.

As illustrated in FIG. 7, in the second embodiment, a protection wrapping bag 50 is employed instead of the protection sheet 25 (the upper protection sheet 25A and the lower protection sheet 25B) of the first embodiment. The protection wrapping bag 50 is an HDPE sheet formed in a bag shape in the same manner as the protection sheet 25 of the first embodiment. When the MFP 10 is packed, the protection wrapping bag 50 is put between the cushion members (the upper cushion member 30 and the lower cushion member 35) and the wrapping bag 20.

Next, an explanation will be provided about operations for packing the MFP 10 in the packing body 1 of the second embodiment, especially focusing on differences between the second embodiment and the first embodiment. In the same manner as the first embodiment, in the second embodiment as well, the packing operator firstly attaches the desiccant D and the drawer 15, which is attached with the process cartridges 16, into the main body housing 11 of the MFP 10. After that, the packing operator wraps the MFP 10 in the wrapping bag 20 and seals the wrapping bag 20 with adhesive tape.

As described above, in the second embodiment, the protection wrapping bag 50 is employed instead of the protection sheet of the first embodiment. Namely, in the second embodiment, the packing operator further wraps, in the protection wrapping bag 50, the MFP 10 wrapped in the wrapping bag 20, instead of the operations in the first embodiment of "spreading the lower protection sheet 25B on the lower cushion member 35," "placing the MFP 10 (wrapped in the wrapping bag 20) on the lower cushion member 35 on which the lower protection sheet 25B is spread," and "covering the upper portion of the MFP 10 (wrapped in the wrapping bag 20) with the upper protection sheet 25A."

Accordingly, the packing operator puts the protection wrapping bag 50 over the MFP 10 wrapped in the wrapping bag 20, and seals the protection wrapping bag 50 with adhesive tape. Namely, the MFP 10 is wrapped doubly in the wrapping bag 20 and the protection wrapping bag 50. Thus, the protection wrapping bag 50 is present everywhere outside the wrapping bag 20 which wraps the MFP 10 therein.

Thereafter, the packing operator places the MFP 10, which is wrapped in the wrapping bag 20 and the protection wrapping bag 50, on the loading section of the lower cushion member 35. Thereby, the protection wrapping bag 50 is certainly placed between the lower cushion member 35 and the wrapping bag 20. Further, packing operator attaches the first upper cushion member 30A and the second upper cushion member 30B to the upper portion of the MFP 10 wrapped in the wrapping bag 20 and the protection wrapping bag 50. As described above, the MFP 10 wrapped in the wrapping bag 20 is entirely wrapped in the protection wrapping bag 50. Therefore, the protection wrapping bag 50 is certainly placed between the upper cushion member 30 (the first upper cushion member 30A and the second upper cushion member 30B) and the wrapping bag 20.

As described above, the packing body 1 of the second embodiment provides the same effects as the first embodiment. Further, according to the packing body 1 of the second embodiment, the packing operator further wraps the MFP 10, wrapped in the wrapping bag 20, in the protection wrapping bag 50. Then, the packing operator attaches the upper cushion member 30 and the lower cushion member 35 to the MFP 10 wrapped in the wrapping bag 20 and the protection wrapping bag 50, from the outside of the protection wrapping bag 50. Hence, according to the packing body 1 of the second embodiment, in the vicinity of the corners of the MFP 10, the protection wrapping bag 50 is certainly placed between the wrapping bag 20 and the cushion member (the upper cushion member 30 and the lower cushion member 35). Consequently, according to the second embodiment, even though a shock is applied to the packing body 1 at the time of transportation of the packing body 1, it is possible to certainly prevent the wrapping bag 20 from being damaged, and to maintain a low-humidity environment in the wrapping bag 20. Thereby, according to the packing body 1, it is possible to prevent the toner, which is wrapped together with the MFP 10 and the desiccant D in the wrapping bag 20, from being deteriorated.

Hereinabove, the embodiments according to aspects of the present invention have been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only exemplary embodiments of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications may be practicable.

<Modifications>

In the aforementioned embodiments, the MFP 10 is cited as an example of an apparatus or a device packed in the packing body 1. However, what is packed in the packing body 1 may be any other apparatus or device to be packed together with a component that might be deteriorated due to an inappropriate degree of humidity. For instance, what is packed in the packing body 1 may be a laser printer to be packed together with a toner cartridge.

In the aforementioned embodiments, the upper cushion member 30 is configured with the first upper cushion member 30A and the second upper cushion member 30B. Nonetheless, the upper cushion member 30 may be configured with a single cushion member. Further, the protection sheet 25 is not limited to that exemplified in the first embodiment with respect to the shape, the size, and the number thereof, as far as the protection sheet 25 is placed to cover the corners of the object to be packed.

What is claimed is:

1. A packing body configured to pack an intended apparatus therein, comprising:

a first sheet formed in such a bag shape as to entirely wrap the intended apparatus therein;

a plurality of upper cushion members comprising:

a first upper cushion member configured to protect first upper and front corners of the apparatus, the first upper cushion member having:

a first upper recess for receiving a first upper corner that is exposed at an upper surface of the apparatus; and a first front recess for receiving a first front corner that is exposed at a front surface of the apparatus, the first front recess being located ahead of and lower than the first upper recess; and a second upper cushion member configured to protect second upper and front corners of the apparatus, the second upper cushion member having:

a second upper recess for receiving a second upper corner that is exposed at the upper surface of the apparatus; and a second front recess for receiving a second front corner that is exposed at the front surface of the apparatus, the second front recess being located ahead of and lower than the second upper recess;

a lower cushion member configured to protect lower corners located at a lower surface of the apparatus, the lower cushion member being positioned lower than each of the first upper cushion member and the second upper cushion member;

a plurality of second sheets comprising:

an upper second sheet configured to wrap the first corners and the second corners and to be placed between the bag-shaped first sheet and the plurality of upper cushion members; and a lower second sheet configured to wrap the lower corners and be placed between the bag-shaped first sheet and the lower cushion member;

the second sheets and the first sheet being formed from a same material configured to cause a lower frictional force between the second sheets and the first sheet than between the second sheets and each of the upper and lower cushion members; and a packing box configured to entirely cover the intended apparatus from an outside of the upper and lower cushion members.

2. The packing body according to claim 1, wherein the second sheet is placed between the first sheet and each of the first upper cushion member and the second upper cushion member in a state where the first upper cushion member and the second upper cushion member are pressed toward an upper portion of the intended apparatus.

3. The packing body according to claim 1, wherein the packing box comprises:

an upper packing box configured to cover a major part of the intended apparatus, the upper packing box having an inner surface configured to contact the upper cushion member and press the upper cushion member toward the intended apparatus; and a lower packing box configured such that the lower cushion member is housed therein.

4. The packing body according to claim 1, wherein the first sheet is formed from airtight material.

5. The packing body according to claim 4, wherein the first sheet is formed from high density polyethylene.

6. The packing body according to claim 1, wherein the second sheet is formed from high density polyethylene.

7. The packing body according to claim 1, wherein the first sheet is configured to entirely wrap the intended apparatus together with a desiccant.

8. The packing body according to claim 1, wherein the cushion member comprises a side cushion member configured to protect a side face of the intended apparatus.

* * * * *